US006499901B1

(12) United States Patent
Rabbani

(10) Patent No.: US 6,499,901 B1
(45) Date of Patent: Dec. 31, 2002

(54) WASHCLOTH THAT MAKES BUBBLES

(76) Inventor: Shahrokh Rabbani, 4957 Lindley Ave., Tarzana, CA (US) 91356

( * ) Notice: Subject to any disclaimer, the term of this patent is extended or adjusted under 35 U.S.C. 154(b) by 0 days.

(21) Appl. No.: 09/891,862

(22) Filed: Jun. 25, 2001

(51) Int. Cl.[7] ..... B43K 8/10
(52) U.S. Cl. ..... 401/201; 15/208; 15/229.11
(58) Field of Search ..... 401/201, 6, 8, 401/7, 196; 383/109, 117; 15/208, 209.1, 229.11

(56) References Cited

U.S. PATENT DOCUMENTS 3,124,827 A * 3/1964 Hull ..... 401/201
3,860,349 A * 1/1975 Scott ..... 401/201
3,977,796 A * 8/1976 Gillespie et al. ..... 401/201
5,022,517 A * 6/1991 Benitez ..... 401/201
5,486,064 A * 1/1996 Schulte ..... 401/201
6,210,062 B1 * 4/2001 Kokubo ..... 401/201
6,227,742 B1 * 5/2001 Corn et al. ..... 401/201

* cited by examiner

*Primary Examiner*—Charles R. Eloshway
(74) *Attorney, Agent, or Firm*—Albert O. Cota

(57) ABSTRACT

A hand-held washcloth of balloon like fabric, for washing and scrubbing a body part and for capturing a washing article, such as a bar of soap, other washing and cleaning agents, or a combination thereof. The device is inflated by mouth, and tied at the neck by a closing attachment, such as, a string, clipping device or both. The washcloth device has a balloon like body, that could have any shape, but must includes a neck for holding and inserting the cleaning article and blowing air into the body. By pushing on the body of the device, bubbles come out from the surface. The body also includes a pair of handles for holding and washing body parts, and can be used for hanging during storage.

8 Claims, 3 Drawing Sheets

SEC A-A

WASHCLOTH THAT MAKES BUBBLES

BACKGROUND OF THE INVENTION

1. Field of the Invention

The present invention relates to a hand-held washcloth device for washing and scrubbing the body, while initiating bubbles. More particularly, to a hand-held device which by capturing a washing article within and blowing into it to create the bubbles. The invention permits washing body parts while enjoying the bubbles during showering or bathing.

2. Description of the Prior Art

Various devices and types of washcloths for body washing while engaging a bar of soap or detergents have been invented. Even though these inventions may be suitable for specific individuals to which they address, they function differently from the present invention. The instant invention uses a washing article to generate bubbles while taking a shower or a bath. The difficulty with some prior art is reaching the back of a person with ease, another is that they usually are used for scrubbing with a bar of soap and the result is like using a conventional washcloth with a soap in it that might slip out and does not create the necessary bubbles for soaping and enjoyment. Additionally, conventional bathing with bubbles, results in wasting a lot of water, time and energy. One more problem that some of prior art inventions do not solve is that when the soap gets small and hard to handle, they dispose of it, which creates another problem which is the waste of our recourses and not fully getting the results of cleaning that one is after, not mentioning the hazards of slipping on a bar of soap. My invention solves all these problems and adds the joy of taking a shower with bubbles or a bath with easier, faster and more economical method.

SUMMARY OF THE INVENTION

A object of the present invention, is to provide a hand-held washcloth for washing and scrubbing body parts and capturing a washing article therein that creates bubbles and adds to the ease of washing and enjoyment to taking a bubble shower or bath.

Another object of the present invention is to provide a hand-held device for washing and scrubbing the body parts therewith and for capturing a washing article that is simple to manufacture and use.

Still another object of the present invention is to provide a hand-held device for washing the body parts therewith and for capturing a washing article that is time saving when used, and prevents waste of our resources, such as water and the washing articles. It is also safe to use.

Another object of the present invention is to provide a hand-held washcloth for washing and scrubbing body parts and for capturing a washing article, such as, soap, other washing and bubbling agents or both. The washcloth includes a balloon like body with a void inside, and an opening on one side for inserting and removing the washing article and blowing air into the body to inflate it, while holding it by the neck. This body is constructed of a fabric like body member, that is flexible, and of material such as, but not limited to, cotton, nylon, terry cloth or a combination thereof, that forms it's shape by stitching around it. The body is impregnated by moving or rubbing it on the washing article inside, with particles of the washing article, generating bubbles on the outside of the body after it's been blown into and pushed or squeezed.

A cord is attached to the body that is used to close the neck after inflation, to keep the air inside. At the two ends of the body are attached handles for holding the device by both hands and washing the hard to reach body-parts, also for hanging the device after use. These handles are made of straps or cords or like material so they will not scratch the body-parts, and be convenient to use. It is, another purpose of these handles to make it easy for people with disabilities to reach all parts of their body-parts with ease.

BRIEF DESCRIPTION OF THE DRAWINGS

The figures on the drawing are briefly described as follows.

Figure 1:
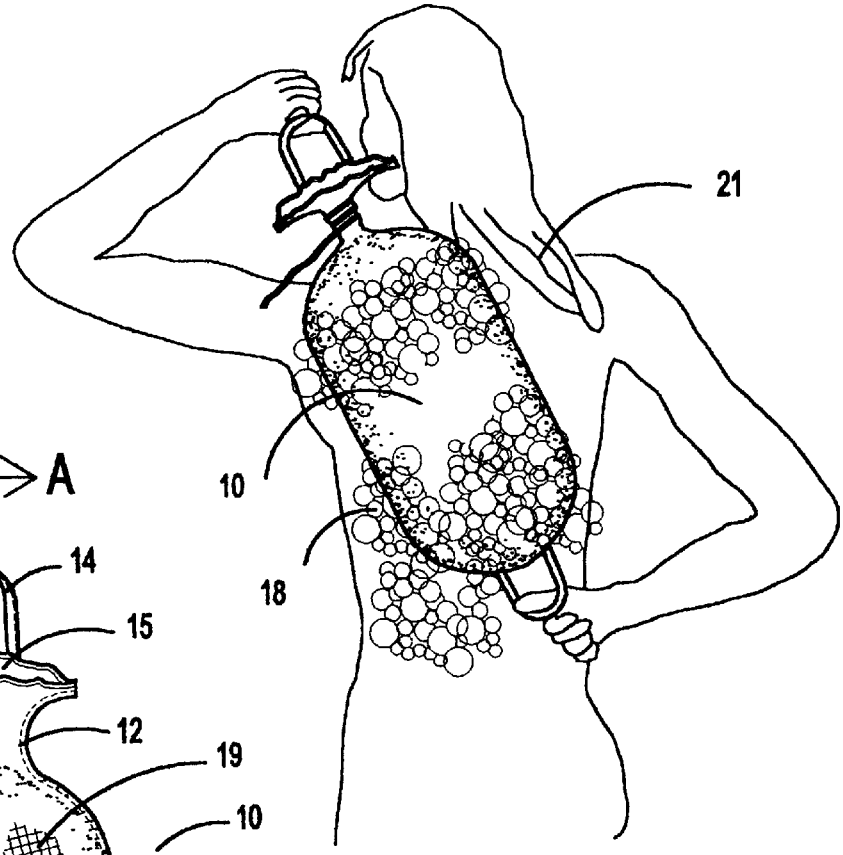
FIG. 1 is a diagrammatic perspective view of the present invention in use in a shower or in the bathtub.

List of reference numerals utilized in the drawings:

10 Washcloth device of present invention for washing and scrubbing body parts 21 and capturing washing article 17 and/for generating bubbles;
11 Body of present invention
12 Neck of present invention for inserting the washing article 17, and for holding the device for blowing into the body 11 and closing it with string 16.
13 Grabbing handle.
14 Grabbing handle.
15 The opening for inserting the washing article and blowing air into the body 11.
16' A clip for closing the neck 12 after the body 11 has been inflated.
17 Washing article.
18 Bubbles.
19 The smooth side for washing and trapping air
20 The rough side for scrubbing
21 Body parts
22 Stitch line

DETAILED DESCRIPTION OF INVENTION

Referring now tho the figures, in which numerals indicates parts, particularly in FIG. 1 the present invention 10 is shown in use for washing and scrubbing body parts with bubbles.

Figure 2:
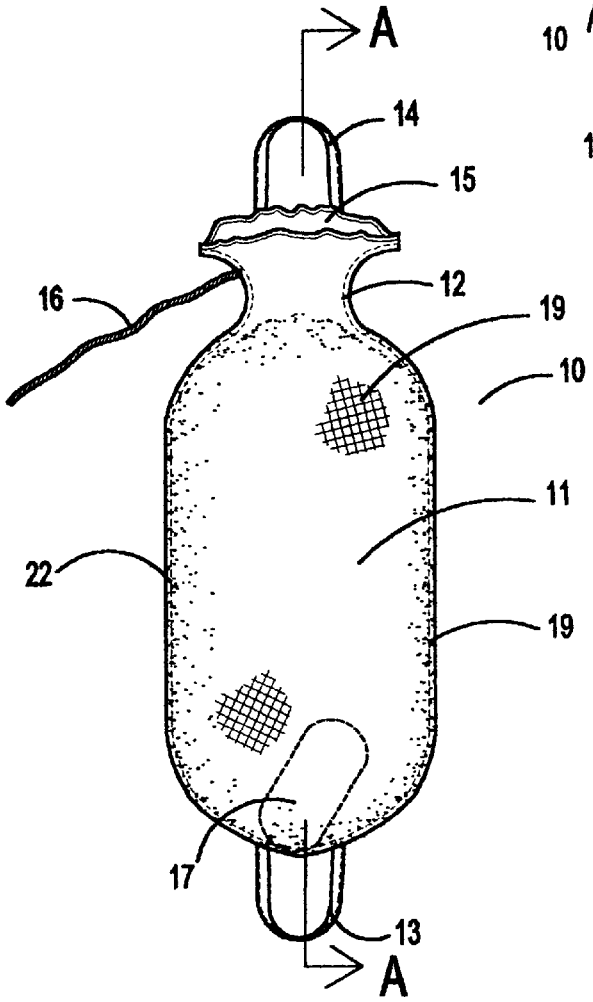
FIG. 2 is a diagrammatic perspective view of the present invention from side and above.
Figure 5:
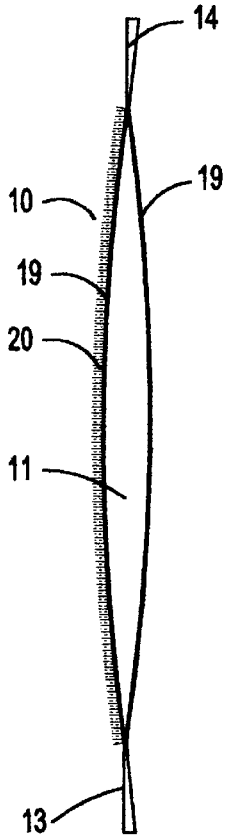
FIG. 5 is a vertical section thru the device.

The present invention as shown in FIG. 2 and FIG. 5 is comprised of three identical pieces of predetermined dimension cloths sewn together at a stitch line 22 with an opening 15 at one side, creating a cavity in between. A piece of string 16 is attached to the neck 12, in the same manner, or a clip 16' is added for closing the neck after the body has been inflated.

Yet furthermore two handles 13 and 14, preferably made of the same cloth, have been attached to the two ends, lengthwise, for grabbing and washing or scrubbing body parts, especially the hard to reach body parts like the back. One of the handles can be used for hanging the device from a hook or the like.

The washcloth device 10, is wetted and has the washing article 17 in the form of a bar of soap or bubbling agents inserted inside from the opening 15 and through the neck 12. Moving and rubbing the washing article 17 inside the body 11, absorbs the soap particles into the body 11, and cloth 19 and impregnates it.

Figure 3:
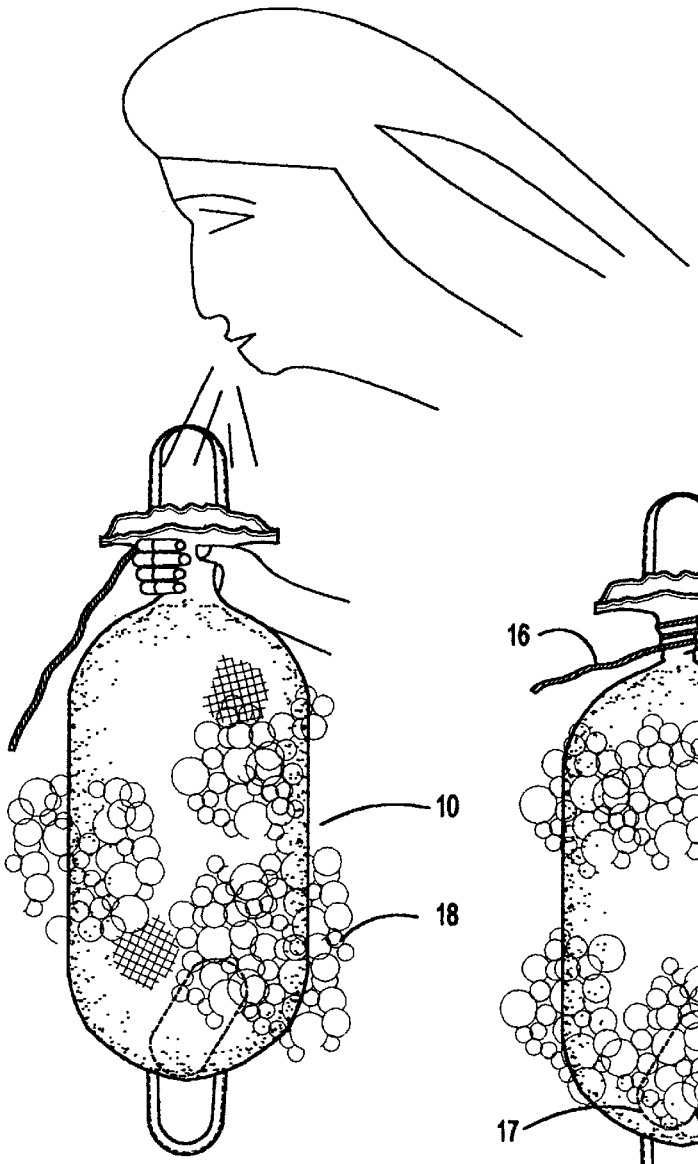
FIG. 3 is a diagrammatic perspective view of the present invention in the state of being blown into, as used in FIG. 1.
Figure 4:
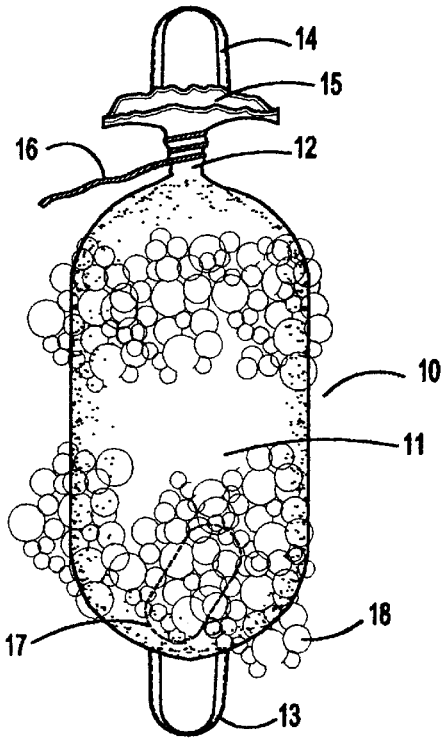
FIG. 4 is a diagrammatic perspective view of present invention after being blown into and closed at the neck, ready for use.
Figure 6:
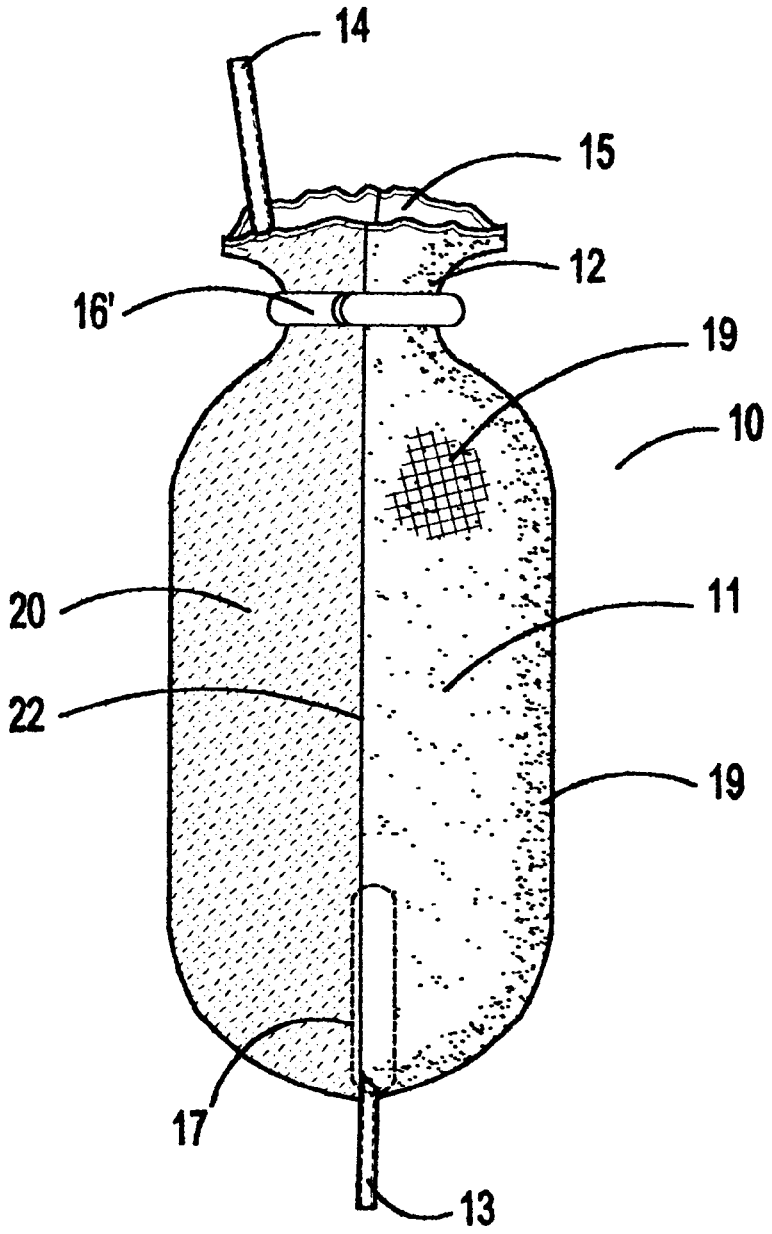
FIG. 6 is a vertical left side view of the present invention in the state of being inflated with a clip closing the neck.

When the body 11 is soaped and ready, by holding the present invention by the neck 12, and blowing into it through the opening 15 in the neck 12, as shown in FIG. 3, the body 11 will be easily inflated until it forms a balloon like shape. By holding the neck 12, wrapping and tying string means in the form of a string 16 or clip 16' around it, the air is trapped inside of the body 11 and bubbles start coming out of the outer surface of the body 11, as shown in FIG. 4. The body 10 is comprised of synthetic fibers, natural fibers or a blend of both with a body smooth side 19 preferably comprised of cotton fibers and a rough side 20 terry cloth.

When the washcloth device is on one's body parts 21, by pushing gently on the body 11, bubbles 18 will come out of the body 11 so they can be rubbed to other body parts. After the body 11 has been deflated, by grabbing the two handles 13 and 14 one can wash with side 19, or scrub his or her body parts with the rough side 20, of terry cloth.

I claim:

1. A hand-held washcloth device for washing and scrubbing body parts for capturing a washing article and generating bubbles comprising, a hollow balloon shaped body for capturing a washing article and air, said body having a neck with an opening for holding, inserting a washing article into the body, and blowing air into the body, said body having two surfaces, a smooth side comprised of cotton fibers and a rough side comprised of terry cloth, string means attached to the neck for closing the neck after air has been blown into the body, for containing air within, a pair of handles for grabbing by a users hands for reaching and washing body parts, and hanging the washcloth device after use, and wherein when said washcloth device is wetted, blown into, with the neck closed, squeezing, generates bubbles for washing body parts while showering or bathing.

2. The washcloth device as defined in claim 1, wherein said washing article is a bar of soap.

3. The washcloth device as defined in claim 1, wherein said washing article is a washing and bubbling agent.

4. The washcloth device as defined in claim 1, wherein said body is comprised of synthetic fibers.

5. The washcloth device as defined in claim 1, wherein said body is comprised of natural fibers.

6. The device as defined in claim 1, wherein said body is comprised of a blend of natural and synthetic fibers.

7. The washcloth device as defined in claim 1, wherein the string means comprises a clip.

8. The washcloth device as defined in claim 1, wherein the string means comprises a piece of string attached to said neck.

* * * * *